US009000337B2

(12) United States Patent
Suominen

(10) Patent No.: US 9,000,337 B2
(45) Date of Patent: Apr. 7, 2015

(54) METHOD DEVICE AND ARRANGEMENT FOR HEATING AN OBJECT BY AN INDUCTION

(75) Inventor: Pekka Suominen, Espoo (FI)

(73) Assignee: EFFMAG Oy, Espoo (FI)

( * ) Notice: Subject to any disclaimer, the term of this patent is extended or adjusted under 35 U.S.C. 154(b) by 407 days.

(21) Appl. No.: 13/255,003

(22) PCT Filed: Feb. 26, 2010

(86) PCT No.: PCT/EP2010/052451

§ 371 (c)(1),
(2), (4) Date: Sep. 6, 2011

(87) PCT Pub. No.: WO2010/100082

PCT Pub. Date: Sep. 10, 2010

(65) Prior Publication Data

US 2011/0315677 A1 Dec. 29, 2011

(30) Foreign Application Priority Data

Mar. 4, 2009 (FI) ..... 20095213

(51) Int. Cl.
*H05B 6/02* (2006.01)
*H05B 6/04* (2006.01)
*H05B 6/10* (2006.01)

(52) U.S. Cl.
CPC ..... *H05B 6/102* (2013.01)

(58) Field of Classification Search
USPC ..... 219/600–677
See application file for complete search history.

(56) References Cited

U.S. PATENT DOCUMENTS

| | | | | | |
|---|---|---|---|---|---|
| 2,451,954 | A | * | 10/1948 | Johns | 322/47 |
| 2,566,274 | A | * | 8/1951 | White et al. | 202/205 |
| 3,272,956 | A | | 9/1966 | Baermann | |
| 3,372,261 | A | | 3/1968 | Porterfield | |
| 4,334,135 | A | * | 6/1982 | Smith | 219/626 |
| 4,511,777 | A | | 4/1985 | Gérard | |
| 4,761,527 | A | | 8/1988 | Mohr | |
| 4,827,169 | A | * | 5/1989 | Habermann | 310/90.5 |
| 5,914,065 | A | * | 6/1999 | Alavi | 219/631 |

(Continued)

FOREIGN PATENT DOCUMENTS

| | | | |
|---|---|---|---|
| CN | 101297123 | A | 10/2008 |
| EP | 0275792 | A1 | 7/1988 |

(Continued)

OTHER PUBLICATIONS

European Search Report from European Patent Application No. 10 711 363.1, dated Aug. 1, 2012, 6 pages.

(Continued)

*Primary Examiner* — Henry Yuen
*Assistant Examiner* — Thomas Ward
(74) *Attorney, Agent, or Firm* — Patterson Thuente Pedersen, P.A.

(57) ABSTRACT

A device for heating an object by an electromagnetic induction comprises at least one rotor, and the rotor comprises at least one permanent magnet. The device also comprises a stator for providing varying magnetic field arranged to interact with at least one magnet of the rotor and causing said rotor to rotate around the axis. The magnets of said rotor is arranged to provide varying magnetic field and eddy currents within the object when said rotor is rotated so that said object is heated by the electromagnetic induction generated by said varying magnetic field and eddy currents.

18 Claims, 8 Drawing Sheets

(56) References Cited

U.S. PATENT DOCUMENTS

| | | | | |
|---|---|---|---|---|
| 6,325,298 | B1 * | 12/2001 | Hielm | 237/12.3 R |
| 2009/0315421 | A1 * | 12/2009 | Onuma et al. | 310/90.5 |
| 2010/0147833 | A1 | 6/2010 | Buehrer et al. | |
| 2011/0037333 | A1 * | 2/2011 | Atallah et al. | 310/98 |

FOREIGN PATENT DOCUMENTS

| | | | |
|---|---|---|---|
| GB | 609718 | | 10/1948 |
| JP | 8-31558 | | 2/1996 |
| JP | 200-231982 | | 8/2000 |
| JP | 2005-38733 | | 2/2005 |
| JP | 2010-537376 | A | 12/2010 |
| WO | WO 02/087285 | A1 | 10/2002 |
| WO | WO 2008/098996 | A1 | 8/2008 |
| WO | WO 2009/024253 | A1 | 2/2009 |

OTHER PUBLICATIONS

Chinese Office Action for Chinese Patent Application No. 2010800197753 dated Aug. 14, 2013, 20 pages (English translation and Chinese language).

Japanese Office Action for Japanese Patent Application No. 2011-552400 (and English translation), Nov. 25, 2014, 10 pages.

* cited by examiner

METHOD DEVICE AND ARRANGEMENT FOR HEATING AN OBJECT BY AN INDUCTION

The present application is a National Phase entry of PCT Application No. PCT/EP2010/052451, filed Feb. 26, 2010, which claims priority from Finland Application 20095213, filed Mar. 4, 2009, the disclosures of which are hereby incorporated by reference herein in their entirety.

TECHNICAL FIELD OF THE INVENTION

The invention relates to a method and device for heating an object by an electromagnetic induction.

BACKGROUND OF THE INVENTION

Induction heating is based on varying magnetic field, which induces eddy currents inside an object and whereupon the object is heated by the eddy currents. Typically the varying magnetic field is implemented by coupling electromagnets around the object to be heated with an alternating current generator of 50 Hz or higher frequency.

There are several induction heaters in metal industry used for heating metals for shaping, forming and heat treatments. For example in extrusion of aluminium and copper, metal bars weighing hundreds of kilogram are heated into a suitable temperature before extruding usually with induction heating. However, often the objects are heated beforehand e.g. by an oven and only the last heating is provided by the induction.

The changing magnetic field required for induction heating can be achieved not only by adjusting the strength of the magnetic field but also by changing the direction of the magnetic field in relation to the object to be heated. This can be done either by moving the magnetic field or by moving the object to be heated. Both have their disadvantages. If the objects are large, they are difficult to move, like to rotate enough. If, on the other hand, electromagnets are used, their sufficient balancing and delivery of current is difficult to carry out with required rotational speeds.

Accordingly, one potential alternative has proved to be magnets rotated around the object to be heated or alternatively moving the object to be heated in the magnetic field induced for example by the electromagnets. This prior art in the field of the technique has been presented in the patent publication U.S. Pat. No. 4,761,527.

There are however some disadvantages relating to the known prior art, such as the complexity and inefficiency of the devices. The devices typically have electromagnets, whereupon the power supply for the magnets is needed. In addition a motor or the like is needed in order to provide driving force either for moving the magnets around the object to be heated or moving the object in the magnetic field of the electromagnets. In order to deliver the driving force from the motor either the electromagnets and/or the object an additional driving mechanism is needed, which make the device more complex and also ineffective and expensive. Also the moving the heavy and large object (weighing e.g. hundreds of kilogram) in the magnetic field so that the object is really heated by the induction is very difficult and also unsafe, or at least massive safety arrangement is needed around the moving heavy object.

In addition, with the magnet rotated around the object to be heated the object can be heated essentially to a desired temperature. However, in many embodiments it is not sufficient that the object is heated relatively evenly to a specific temperature. For example a metal or aluminium bar to be extruded, billet, has to be heated in longitudinal direction to have a specific changing temperature profile, so that it can be extruded into a homogeneous profile. In other words the head of the billet has to be warmer and suitable for starting the extrusion whereas the tail has to be colder, so that it doesn't heat too much during the extrusion.

SUMMARY OF THE INVENTION

An object of the invention is to alleviate and eliminate the problems relating to the known prior art devices. Especially the object of the invention is to simplify the prior art devices for heating an object via an electromagnetic induction and make them more effectiveness as well as safer.

The object of the invention can be achieved by the features of independent claims.

The invention relates to a device for heating an object by an electromagnetic induction, wherein the device comprises at least one rotor arranged to heat the object, said at least one rotor comprising at least one permanent magnet, and a stator for providing varying magnetic field arranged to interact with at least one permanent magnet of said at least one rotor and causing said at least one rotor to rotate, and wherein at least one permanent magnet of said at at least one rotor is arranged to provide varying magnetic field and eddy currents within the object when said at least one rotor is rotated so that said object is heated by the electromagnetic induction generated by said varying magnetic field and eddy currents. In addition the invention relates to a rotor for heating an object by an electromagnetic induction, the rotor comprising at least one permanent magnet arranged to provide varying magnetic field and eddy currents within the object to be heated when said rotor is rotated in a proximity of the object, so that said object is heated by the electromagnetic induction generated by said varying magnetic field and eddy currents, an arrangement for heating an object by an electromagnetic induction, wherein the arrangement comprises at least one device for providing said electromagnetic induction in order to heat said object and a method for heating an object by an electromagnetic induction, and a driver arrangement for supplying electric power for a heating device.

According to an embodiment of the invention a device for heating an object by an electromagnetic induction comprises at least one rotor, wherein the rotor comprises at least one permanent magnet. Advantageously the rotor comprises plurality of permanent magnets in order to provide more effective induction. In addition the device comprises also a stator for providing a varying magnetic field, which is arranged to interact with at least one magnet of the rotor and thereby causing said rotor to rotate. The varying magnet field may be rotating or otherwise changing magnet field. According to the embodiment at least one magnet of the rotor is arranged to provide a varying (inducing) magnetic field and eddy currents within the object when said rotor is rotated so that said object is heated by the electromagnetic induction generated by said varying magnetic field and eddy currents induced by said at least one magnet of the rotor.

The object to be heated is advantageously at least partially electrically conducting so that the varying magnet field may induce eddy current within said object. The object is advantageously a metal object, such as aluminium or copper billet.

According to an embodiment of the invention at least one magnet of the rotor is same for providing varying magnetic field and eddy currents within the object, as well as interacting with the varying magnetic field provided by the stator. In other words the same permanent magnets of the rotor are advantageously used both for rotating said rotor and heating said object via induction they generate.

According to an embodiment the stator is adapted to cover electromagnetically and/or physically only a segment of the rotor's surface and not the whole surface area of the rotor. This has advantages, namely the more compact and simpler device can be achieved, when the object to be heated may locate at the same side of the rotor than the stator. In addition the same stator may be used for rotating multiple rotors, whereupon the induction heating is much more effective.

According to another embodiment the rotor with the magnets is located essentially between the object to be heated and the stator, whereupon the stator effecting with the whole surface area of the rotor can be applied, which may allow more effective device (the torque or axial moment of the rotor may be increased allowing more powerful heating).

In addition according to an embodiment the induction heating device of the invention can be provided by balance detection means for detecting e.g. the balancing of the rotating rotor. The balancing detection means may be for example similar than used in wheel balancing machines. Thus it can indicate the balance and/or unbalance and even determine the weight and location of the balance counter weigh to be added.

Furthermore, according to an embodiment the induction heating device of the invention can be provided by magnetic flux detection means for detecting e.g. the regularity of the magnetic flux when the rotor with magnets is rotated. The magnetic flux detection means advantageously detects the magnetic flux of each magnets of the rotor when rotating. The abnormal behaviour may exist for example if a magnet is e.g. demagnetized, which can be determined from the current induced into the induction loop (the induced current does not behave regularly anymore when there is any problems with the magnets). If the detection reveals any abnormal behaviour, it is indicated. The magnetic flux detection means may comprise for example an induction loop to which a current is induced by the magnets moving in the proximity.

Moreover, according to an embodiment the induction heating device of the invention can be provided by distance detecting means for detecting the distance between the rotor and the object to be heated. The detecting means may be implemented e.g. by a laser emitting and receiving means, possibly adapted to indicate or stop the rotation of the rotor if said distance is below a certain threshold. It should be noted that the distance between the object and the rotor may be decreased during the heating of the object due to heat expansion.

Still, according to an embodiment the induction heating device of the invention can be provided by a cooling element adapted to cool the rotor and/or stator especially during the operation. The cooling element may be e.g. a wing or cooling channel conduit or passage, or the like known by the skilled person.

According to an induction heating method of the invention two things may be performed simultaneously for heating for example an elongated metal object. In the embodiment permanent magnets may be rotated around the object being heated and simultaneously the object and magnets may be moved in relation to each other in longitudinal direction of an elongated object for inducing the desired longitudinal temperature distribution into the object. In this way the first end of the object may have different temperature than the other end. This is advantageous for example in extruding process, where the first end of the object should typically be warmer than the last end. This is because when the object is extruded its temperature will increase.

Even though moving of the rotated magnets and elongated object in relation to each other can be done in many ways, it is advantageous, that the magnets are rotated in situ and the object to be heated is moved with suitable transferring devices for example through the circle formed by rotating magnets or other kinds of magnetic field. Moving can be happened with constant speed whereupon the object will be heated isothermally. If the speed of transmission is accelerating the head of the object will become warmer and respectively with decelerating speed the tail becomes warmer. Of course also more varying temperature distributions are possible only by changing appropriately the speed of transmission of a metal object.

The magnets rotating around an object to be heated may cause a strong torque or other forces to the object, due to which the object has to be hold strong when heating an object with one rotating magnetic circuit. Accordingly, in the advantageous embodiment of the invention at least two rotating permanent magnetic circuits are used, which have been located in distance from each other for example in longitudinal direction of the object to be heated and whose directions of rotation vary in order to compensate the torque or other forces caused to the object. This enables using for example two or more similar (or different) magnetic circuits, which are rotated in opposite directions with the same or differing rotational speed.

Advantageous in the invention is also, that the effective area of influence of the magnetic circuits to be used in the longitudinal direction of the object to be heated is small in relation to the length of the metal object, for example at maximum 20% of the length of the metal object. So magnets do not necessarily heat the metal object evenly, but a varying temperature profile can be achieved in it, for example warmer in the middle than in the ends.

An exemplary induction heater device for heating an object according to an embodiment of the invention comprises a with central hole provided rotatable circle, to which permanent magnets are attached. The device further comprises supporting devices for supporting the object to the hole so that it is off the circuit which means that it doesn't touch the circuit and it is further parallel to the rotational axis of the circle. The device further comprises transferring elements for moving the object controlled through a hole for inducing a desired longitudinal temperature distribution into a metal object.

As a metal object to be heated in the device of the invention can be for example aluminium, copper or billet of stainless steel or a bar, which is heated into a suitable temperature for example before extrusion into a specific profile. Also other objects which are suitable for heating via electromagnetic induction can be heated with the devices of the invention disclosed in this document. In order to be suitable for heated via electromagnetic induction the object should advantageously comprise metal or electrically conducting material, such as for example carbon fibres.

Permanent magnets used in the devices of the invention described in this document comprise according to an embodiment of the invention advantageously neodymium (Nd), iron (Fe) and boron (B).

The method and devices according to the invention has significant advantages in relation to the prior art. At first economical savings can be achieved when less material is needed for manufacturing the device, because the magnets of the rotor is used both for rotating said rotor in the varying magnetic field generated by the stator and inducing eddy currents within the object to be heated. In addition the simpler devices can be achieved, since no additional motor or driving arrangements are needed for rotating magnets and/or object in order to generate eddy currents within the object to be heated. Furthermore the operating efficiency of the induction heating is already in principle much higher than for example heating the object by e.g. an oven, so when the object is heated from the beginning with the induction heating devices of the invention even more economical savings can be achieved.

Moreover, with the invention, different objects, such as elongated metal objects, can be heated individually, evenly and accurately into a desired temperature or to have a desired temperature distribution.

BRIEF DESCRIPTION OF THE DRAWINGS

Next the invention will be described in greater detail with reference to exemplary embodiments in accordance with the accompanying drawings, in which.

DETAILED DESCRIPTION

Figure 1:
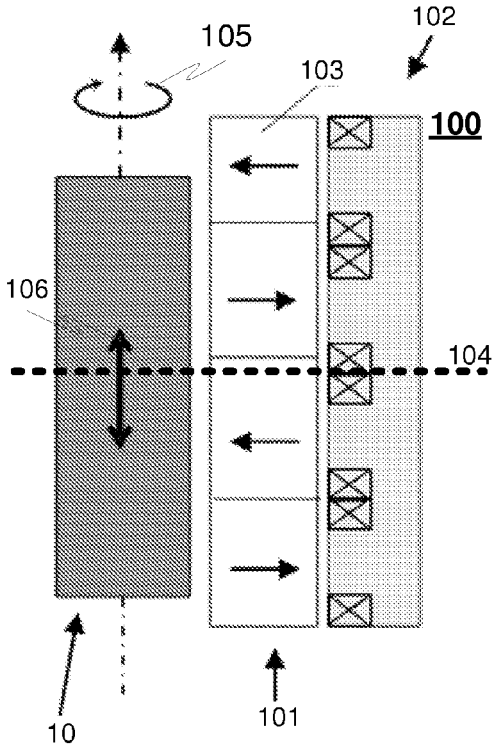
FIG. 1 illustrates a principle of an exemplary device for heating an object via electromagnetic induction according to an advantageous embodiment of the invention.

FIG. 1 illustrates a principle of an exemplary device 100 for heating an object 10 via electromagnetic induction according to an advantageous embodiment of the invention. The device 100 comprises advantageously a rotor 101 with plurality of permanent magnets 103, and a stator 102 for providing varying magnetic field. The magnetic field provided by the stator 102 is arranged to interact with at least one magnet 103 of the rotor 101 and thereby cause said rotor 101 to rotate around its axis 104.

At least one magnet 103 of said rotor 101 is arranged to provide varying magnetic field and eddy currents within the object 10 when said rotor 101 is rotated so that said object is heated by the electromagnetic induction generated by said varying magnetic field and eddy currents. According to an advantageous embodiment of the invention the magnet 103 of the rotor 101 for providing varying magnetic field and eddy currents within the object 10 is same as for interacting with the varying magnetic field provided by the stator 102 and causing the rotation of said rotor 101.

Structurally very simple induction heating device 100 can be achieved when the same magnet 103 is used for both rotating the rotor as well as also inducing varying eddy currents within the object. For example no additional driving mechanisms for rotating said rotor are needed, such as belt gear, gear wheel or transmitting shaft, which is clear advantage.

Figure 2:
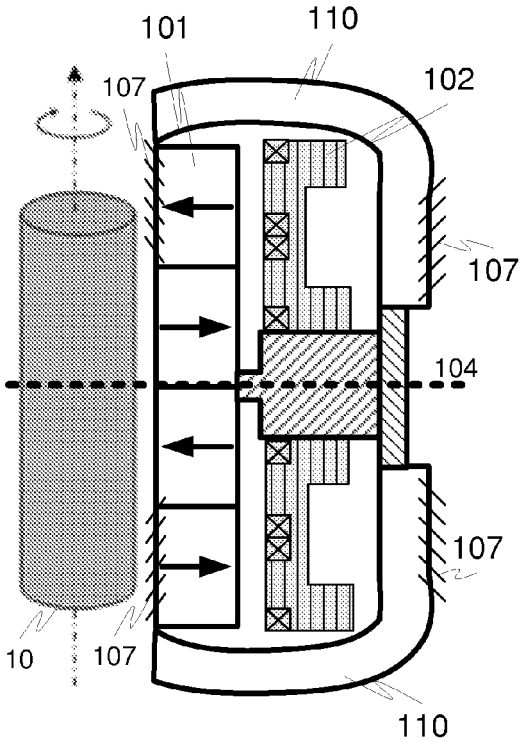
FIG. 2 illustrates an exemplary device for heating an object via electromagnetic induction according to an advantageous embodiment of the invention.

FIG. 2 illustrates an exemplary device 100 for heating an object 10 via electromagnetic induction according to an advantageous embodiment of the invention, where the stator 102 and the rotor 101 are encapsulated within a housing 110. According to an embodiment the housing may be made of metal, whereupon it is important that the housing is arranged so that it does not disturb the magnetic field induced by the magnets of the rotor 101 especially in the direction of the object 10, so the magnetic fields which are used for inductively heat the object. The housing 110 may in addition comprise cooling element 107, such as cooling fin, radiating rib, wings or other cooling means, e.g. conduit, known by the skilled person in order to cool the rotor and/or stator.

Figure 3:
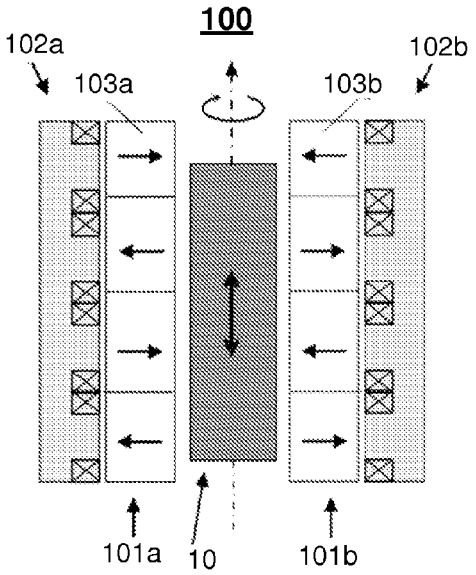
FIG. 3 illustrates a principle of another exemplary device with two rotors for heating an object via electromagnetic induction according to an advantageous embodiment of the invention.

FIG. 3 illustrates a principle of another exemplary device 100 with two rotors 101*a*, 101*b* for heating an object 10 via electromagnetic induction according to an advantageous embodiment of the invention. The device 100 illustrated in FIG. 3 comprises the own stator 102*a*, 102*b* for each rotor 101*a*, 101*b*. The device having two rotors with plurality of permanent magnets induces eddy currents within the object much more powerfully, and the object is heated more effectively than using only one rotor or fewer magnets.

It should be noted that the device 100 can be modified so that it comprises only one stator (e.g. 102*a*) for rotating both rotors 101*a*, 101*b* so that the first rotor (e.g. 101*a*) is rotated by the varying magnetic field provided by the first stator (e.g. 102*a*) and the rotating force for the second rotor (e.g. 101*b*) is delivered e.g. by a driving mechanism, such as using a belt gear or the like. The driving mechanism advantageously delivers the rotating force from the first rotor (101*a*), which is rotated by the varying magnetic field induced by the first stator (102*a*).

Again it should be noted the at least one additional rotor 101*a* may be arranged to rotate in different direction that at least one other rotor 101*b* of the device 100 in order to compensate forces induced into the object, as is depicted also elsewhere in this document.

Figure 4:
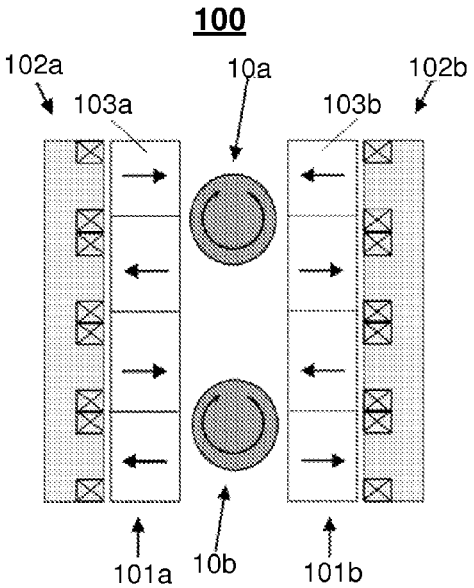
FIG. 4 illustrates a principle of another exemplary device with two rotors for heating at least two objects via electromagnetic induction according to an advantageous embodiment of the invention.

FIG. 4 illustrates another exemplary principle of the device 100 with two rotors 101*a*, 101*b* for heating at least two objects 10*a*, 10*b* via electromagnetic induction according to an advantageous embodiment of the invention.

In the device 100 illustrated e.g. by FIGS. 1-4 the rotor 101 with the magnets 103 and the stator 102 are arranged so that when heating the object 10 the rotor 101 with the magnets 103 locates essentially between the object 10 to be heated and the stator 102. The object can be rotated around its axial or longitudinal axis 105 so that the heating will be distributed more uniformly especially in the surface of the object. In addition the object may be moved in the axial direction 106 of its longitudinal axis in order to achieve temperature distribution between the ends of the object to be heated, as discussed elsewhere in this document. This will apply also to devices and embodiments illustrated in connection with other Figures of the invention, even though it is not separately mentioned.

Figure 5:
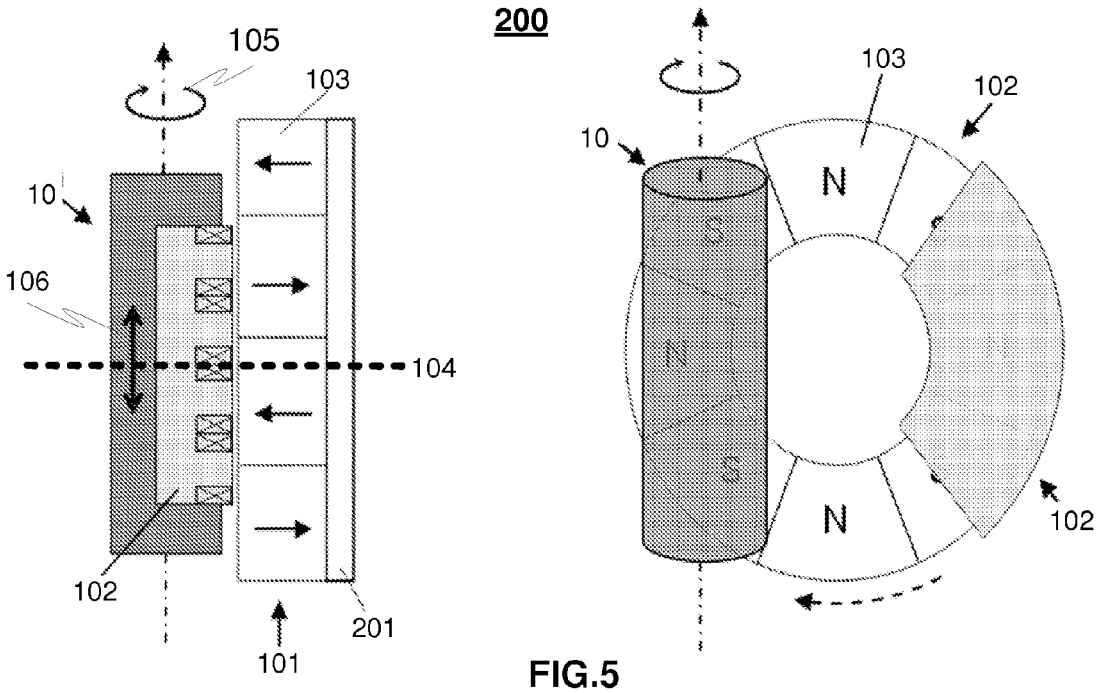
FIG. 5 illustrates a principle of further exemplary device for heating an object via electromagnetic induction according to an advantageous embodiment of the invention.
Figure 6:
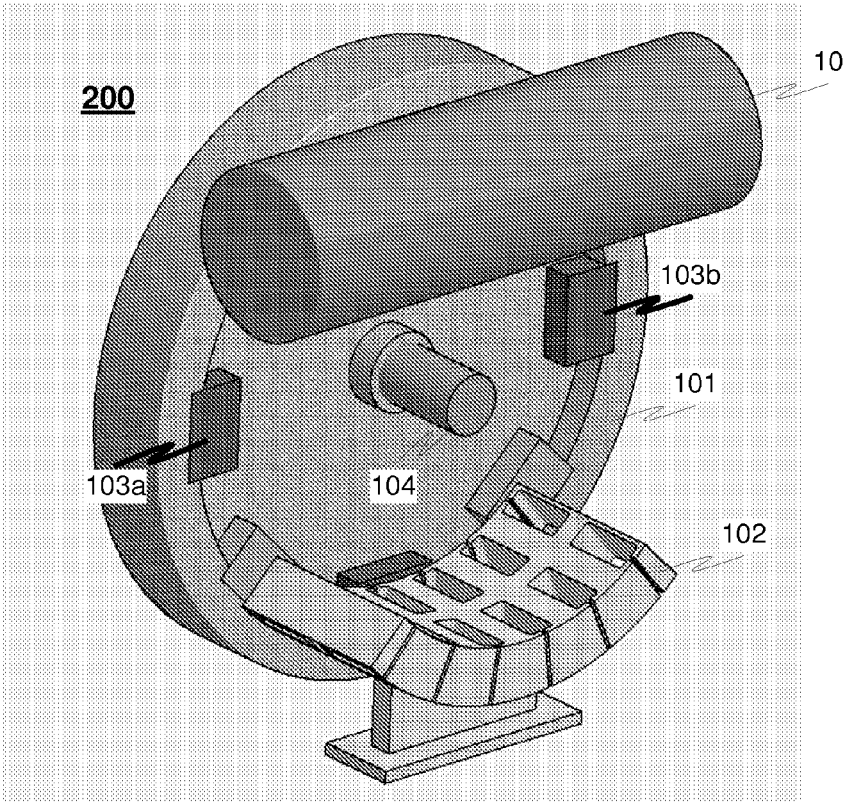
FIG. 6 illustrates a further exemplary device for heating an object via electromagnetic induction according to an advantageous embodiment of the invention.
Figure 7:
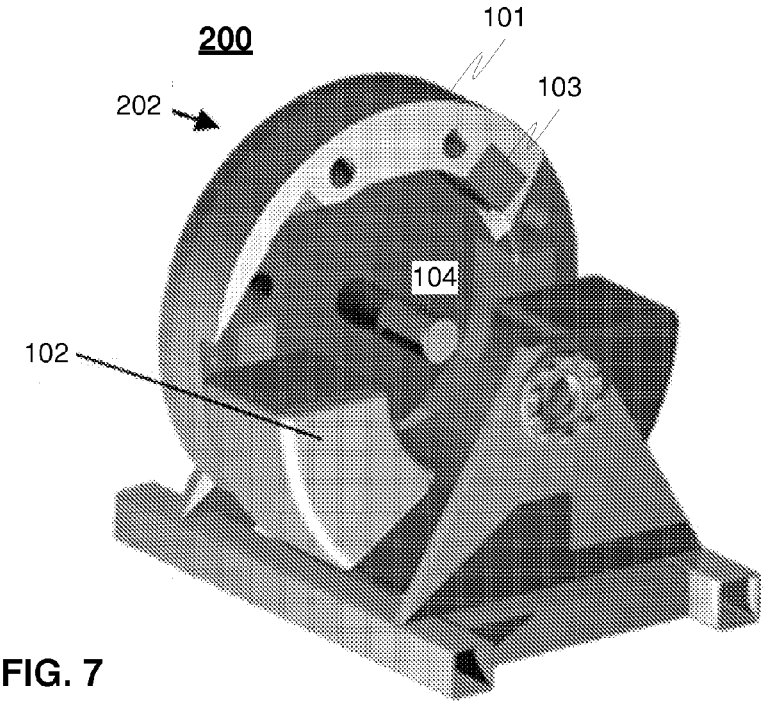
FIG. 7 illustrates a further exemplary device for heating an object via electromagnetic induction according to an advantageous embodiment of the invention.

FIGS. 5, 6 and 7 illustrate a principle of further exemplary device 200 for heating an object 10 via electromagnetic induction according to an advantageous embodiment of the invention. The device 200 comprises also stator 102 and the rotor 101 with permanent magnets 103, 103*a*, 103*b*, but the relative positions of the stator 102 and rotor 101 is different than in the device 100, for example. In the device 200 the stator 102 is arranged so that it locates essentially in the same side in view of the rotor 101 than the object 10 to be heated (in the direction of the axis 104). This offers an additional advantage, namely the device 200 may be even more compact than the device 100.

In order to make enough space for the object 10 to be heated the stator is arranged to cover electromagnetically and/or physically only a segment of the rotors surface. When viewing in the direction of the axis 104 the segment of the rotors surface covered by the stator is less than the full surface area of the rotor's surface facing towards the stator. This can be clearly seen especially in FIGS. 6 and 7.

It is also clear from the FIG. 6 that the magnetic field generated by the stator 102 is not necessary rotating magnetic field, but in some other way varying magnetic field. However the magnetic field can be arranged to vary so that it causes the rotor 101 to rotate around its axis 104, even though the stator is not full circle or does cover only part of the surface of the rotor. In addition the stator as well also the rotor 101 are advantageously covered at least partly with a housing 202.

In addition the device 200 comprises advantageously a short circuiting means 201 (FIG. 5 and FIG. 8, for example) for magnetically short circuiting the magnetic circuit of the magnets 103, 103*a*, 103*b* of the rotor 101 in the side opposite of the side facing essentially towards the stator 102 (in the direction of the axis 104). The short circuiting means 201 advantageously comprises soft magnetic material, such as iron (Fe) or magnetic steel. The short circuiting means 201 has advantages, since it strengthens the magnetic field of the magnets 103 in the side of the object 10 so that the induction magnetic field inducing eddy current within the object 10 is even more effective. In addition the short circuiting means 201 also strengthens the mechanical structure of the rotor 101.

Figure 8:
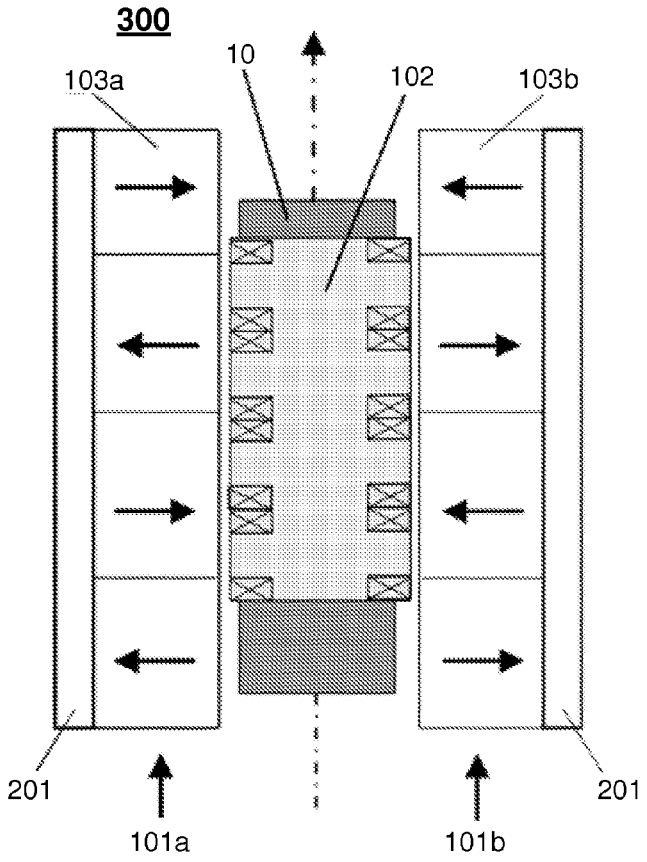
FIG. 8 illustrates a principle of further exemplary device with two rotors for heating an object via electromagnetic induction according to an advantageous embodiment of the invention.

FIG. 8 illustrates a principle of further exemplary device 300 with two rotors 101*a*, 101*b* with magnets 103*a*, 103*b* for heating an object 10 via electromagnetic induction according to an advantageous embodiment of the invention. The device 300 is according to an embodiment otherwise similar than the device 200 illustrated in FIGS. 5-7, for example, but it 300 advantageously comprises only one stator unit 102, which is used to rotate both the rotors 101*a*, 101*b*. This is possible, when the stator 102 is arranged between the rotors 101*a*, 101*b*, as illustrated in FIG. 8. The embodiment of FIG. 8 has additional advantages, namely the device 300 can be even more compact and more effective.

Figure 9:
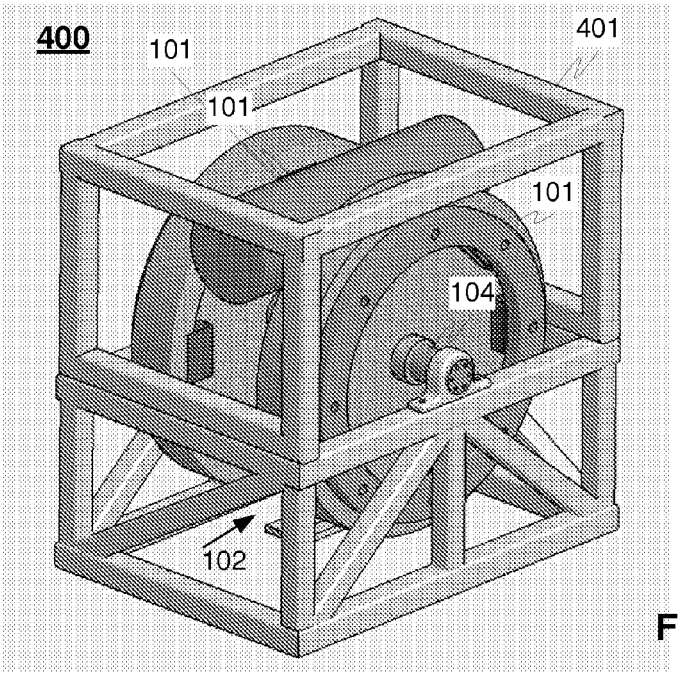
FIG. 9 illustrates a principle of an exemplary arrangement for heating an object via electromagnetic induction according to an advantageous embodiment of the invention.

FIG. 9 illustrates a principle of an exemplary arrangement 400 for heating an object 10 via electromagnetic induction according to an advantageous embodiment of the invention. The arrangement comprises a base 401 for supporting the rotor(s) 101 and stator(s) 102 of the induction heating devices illustrated elsewhere in this document. The supporting may be implemented e.g. via an axel 104.

Figure 10:
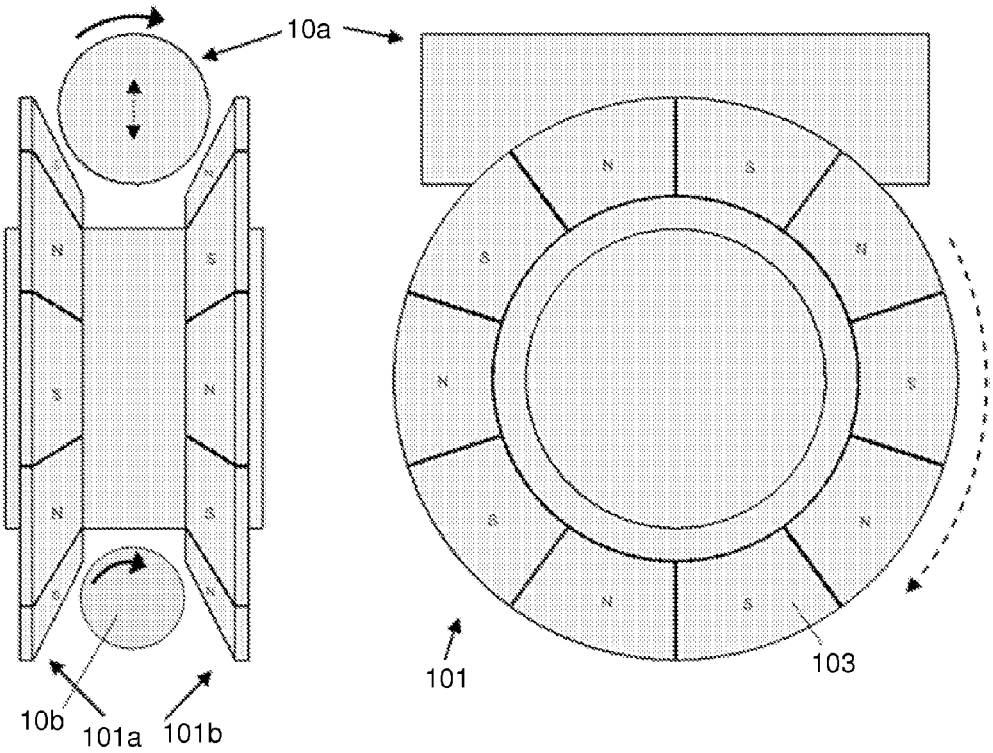
FIG. 10 illustrates a principle of an exemplary non-parallel magnet fields for heating an object via electromagnetic induction according to an advantageous embodiment of the invention.

FIG. 10 illustrates a principle of an exemplary non-parallel magnet fields induced by the rotors 101*a*, 101*b* for heating an object 10*a*, 10*b* via electromagnetic induction according to an advantageous embodiment of the invention. The non-parallel magnet fields may be achieved for example either with conical-shaped rotor(s) 101*a*, 101*b*, for example, or two or more rotors arranged in an angle in relation to each other (such as illustrated in FIGS. 12 and 13). This provides an additional advantage, namely the objects 10*a*, 10*b* with different size can be effectively heated, because both can be located in the proximity of the rotor(s).

Figure 11:
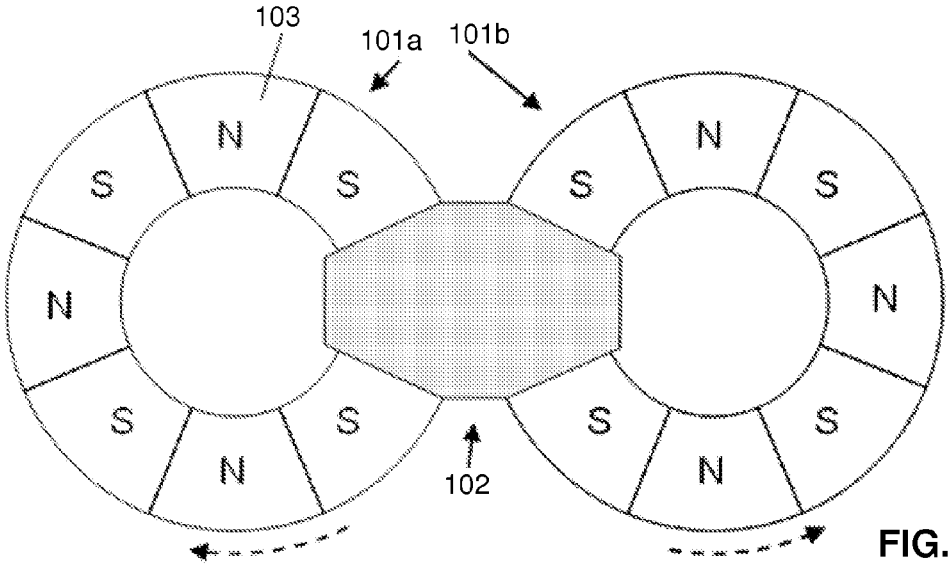
FIG. 11 illustrates a principle of an exemplary device with two rotors for heating an object via electromagnetic induction according to an advantageous embodiment of the invention.

FIG. 11 illustrates a principle of an exemplary device with two rotors 101*a*, 101*b* for heating an object via electromagnetic induction according to an advantageous embodiment of the invention, where the one stator 102 is used for rotating both rotors 101*a*, 101*b*. According to the embodiment illustrated in FIG. 11 the rotors are rotated around the different axis. In addition when the stator 102 and the rotors 101*a*, 101*b* are arranged as illustrated in FIG. 11, the rotors 101*a*, 101*b* are rotated in different directions, the first one in the clockwise and the other one in the counter clockwise, which in additionally may compensate the forces induced in the object.

Figure 12A:
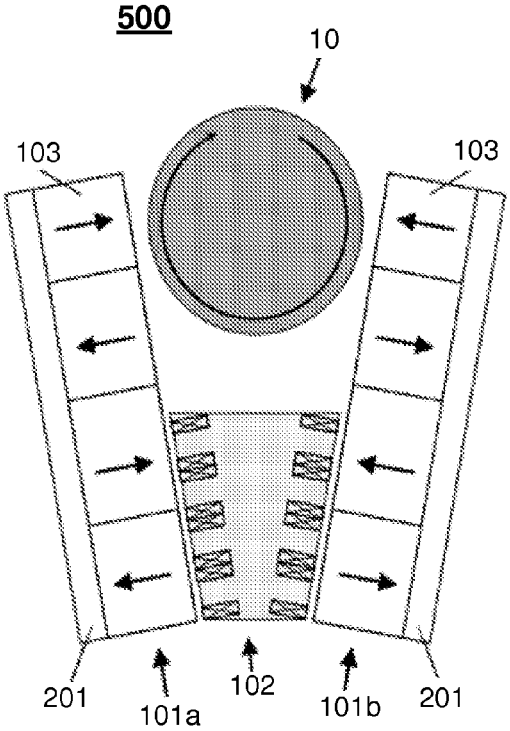
FIG. 12A illustrates a principle of an exemplary device with two non-parallel rotors for heating an object via electromagnetic induction according to an advantageous embodiment of the invention.
Figure 13:
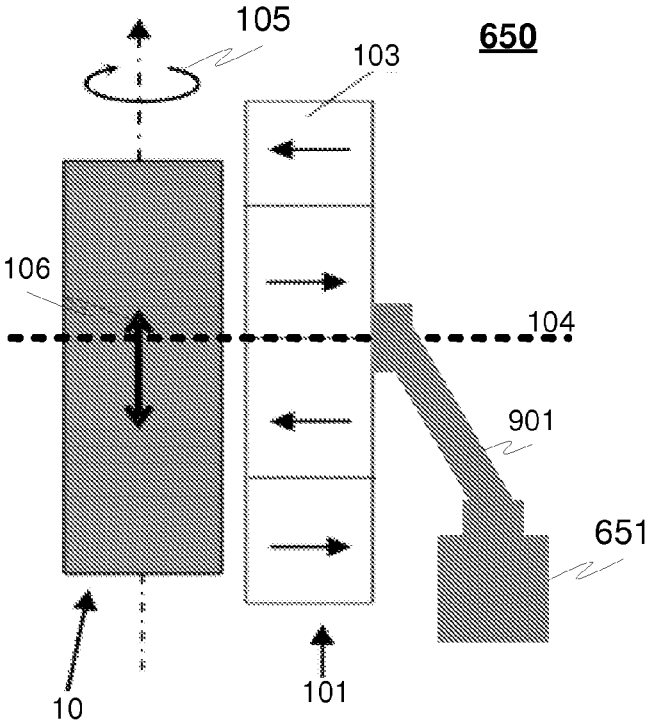
FIG. 13 illustrates an exemplary rotor for heating an object via electromagnetic induction according to an advantageous embodiment of the invention.

FIG. 12A illustrates a principle of an exemplary device 500 with two non-parallel rotors 101*a*, 101*b* for heating an object 10 via electromagnetic induction according to an advantageous embodiment of the invention. The device advantageously comprises only one stator unit 102 for rotating both rotors 101*a*, 101*b*. The device 500 offers advantages, such as compact size and possibility to heat the plurality of objects of different size effectively.

Figure 12B:
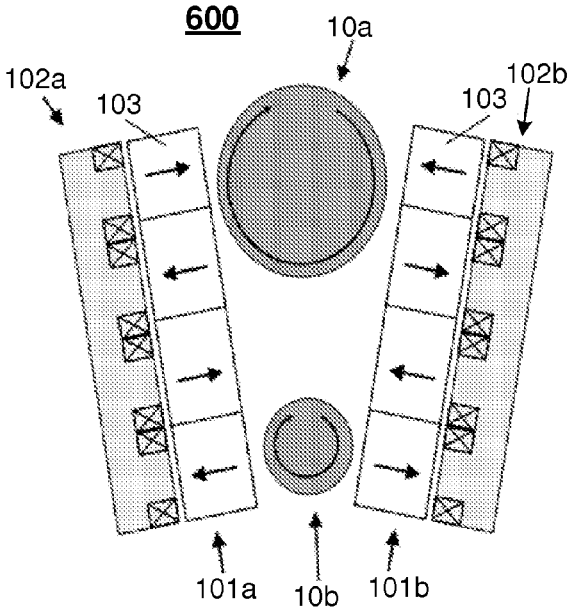
FIG. 12B illustrates a principle of another exemplary device with two non-parallel rotors for heating an object via electromagnetic induction according to an advantageous embodiment of the invention.

FIG. 12B illustrates a principle of another exemplary device 600 with two non-parallel rotors 101*a*, 101*b* for heating at least one object 10*a*, 10*b* via electromagnetic induction according to an advantageous embodiment of the invention. The device 600 advantageously comprises own stator 102*a*, 102*b* for each rotors 101*a*, 101*b*. This is advantageous when the high power and/or torque is needed, or when each of the rotors 101*a*, 101*b* are needed to be rotated independently of each other for example in other reasons. In addition when the rotors 101*a*, 101*b* are non-parallel, the device allows the heating of the objects 10*a*, 10*b* with different diameters.

FIG. 13 illustrates an exemplary rotor 101 and device 650 for heating an object via electromagnetic induction according to an advantageous embodiment of the invention, wherein the rotor 101 comprises at least one, but advantageously plurality of permanent magnets 103 arranged to provide varying magnetic field and eddy currents within the object 10 to be heated when said rotor is rotated in the proximity of the object, such as besides of the object, whereupon the said object 10 is heated by the electromagnetic induction generated by said varying magnetic field and eddy currents.

According to an advantageous embodiment of the invention at least one permanent magnet 103 of the rotor 101 is arranged to interact with a varying magnetic field provided by a stator so that to cause said rotor to rotate. In addition according to the advantageous embodiment of the invention said at least one magnet of said rotor is arranged to provide varying magnetic field and eddy currents within the object when said rotor is rotated by the varying magnetic field provided by said stator so that said object is heated by the electromagnetic induction generated by said varying magnetic field and eddy currents.

However, according to an exemplary embodiment of the invention the rotor 101 in FIG. 13 may also be rotated by a motor 651 either directly or via driving means 901, such as a shaft or belt gear transferring the rotating force from the motor 651. It should be noted that the device 650 may comprise plurality of rotors 101 rotated e.g. by the motor 651.

Figure 14:
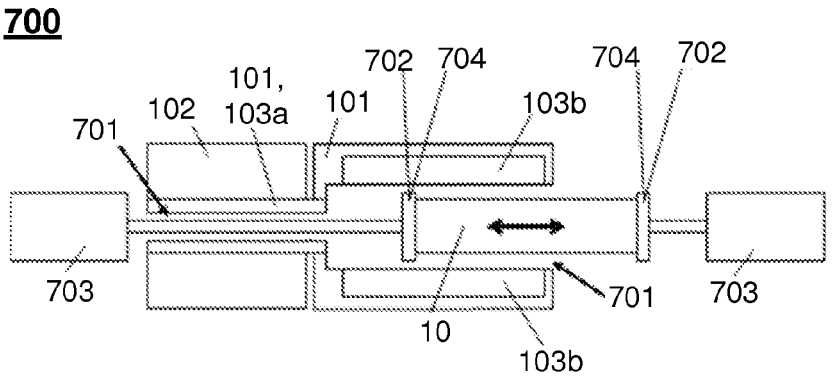
FIG. 14 illustrates an exemplary device with a centric hole for heating an object via electromagnetic induction according to an advantageous embodiment of the invention.

FIG. 14 illustrates an exemplary device 700 with a centric hole 701 for heating an object 10 via electromagnetic induction according to an advantageous embodiment of the invention. In the device 700 the rotor 101 is arranged to be rotated around the common axis of the stator 102 and rotor 101. The axis of the stator and rotor comprise advantageously the central hole 701 (hollow axis) adapted for receiving the object 10 to be heated at least partially.

In the device 700 the permanent magnets 103*a*, 103*b* are advantageously attached to the rotor 101. However, it should be noted that in device 700 the rotor 101 may be an "elongated" rotor (elongated at least partially outside of the varying magnetic field generated by the stator), whereupon at least part of the magnets 103*a* are used for rotating the rotor and at least part of the magnets 103*b* are used for inducing eddy currents within the object 10 to be heated. However, both the stator and the rotor of the device 700 are provided with the central hole 701.

The device 700 advantageously further comprises supporting devices 702 for supporting the object 10 to the hole 701 so that it is off the circuit which means that it doesn't touch the circuit or the rotor or its magnets and it is further essentially parallel to the rotational axis of circle. The device 700 may further comprise transferring means 703 for moving the object 10 controlled through the hole 701 for inducing a desired longitudinal temperature distribution into the object 10. In addition the transferring means may also be used for rotating the object 10 to be heated around its longitudinal axis in order to enable even temperature distribution in the radial direction and the surface of the object.

The function of the supporting devices 702 according to an embodiment of the invention is to carry and support the object 10 to be heated and move it or make it to move through the central hole 701 of the magnetic circuit rotating around it. In one embodiment the supporting devices 702 comprise holding means 704 to be attached to both ends of the object 10 to be heated. So the object 10 is supported from its both ends. Supporting in this connection doesn't mean only carrying the object but it is supported torsionally rigidly by the holding means 704, so that it cannot rotate or twist with the rotation of the magnetic circuit 103*a*, 103*b*.

In another embodiment the supporting devices 702 comprise a bracket or holding means to be attached only to one end of the object to be heated, by which the object is moved in the magnetic circuit.

Advantageously the transferring means 703 comprise a power device and a suitable control device connected to it, with which the object can be moved controllably for example with predetermined constant speed or with changing speed through the hole or otherwise in the magnetic field. According to an embodiment the moving of the object can happen only once in one direction or back and forth or several times back and forth an in addition the moving may also be rotational moving (rotating the object to be heated around its longitudinal axis).

Figure 15:
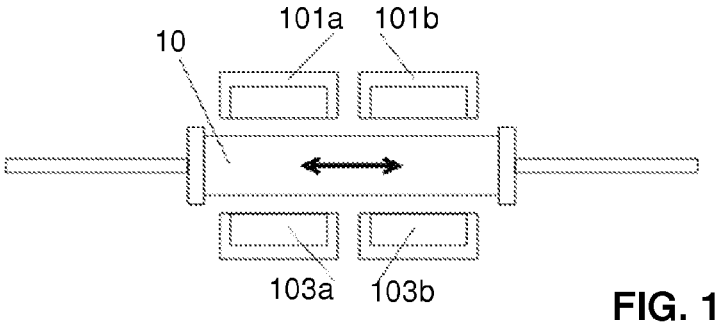
FIG. 15 illustrates an exemplary device with two rotors having centric hole for heating an object via electromagnetic induction according to an advantageous embodiment of the invention.

The magnetic circuit 103*a*, 103*b* rotating around the object 10 causes to the object typically strong torque and the heating object 10 can be twisted. Thus the device 700 may advantageously comprise at least two with central hole and constant magnetic circuit provided concentric rotatable rotors 101*a*, 101*b*, as illustrated in FIG. 15. When different magnetic circuits 103*a*, 103*b* are rotated suitably in opposite directions (either with same or different speed), can the torque or other forces caused to the object 10 to be heated in connection for example with induction be eliminated.

Figure 16:
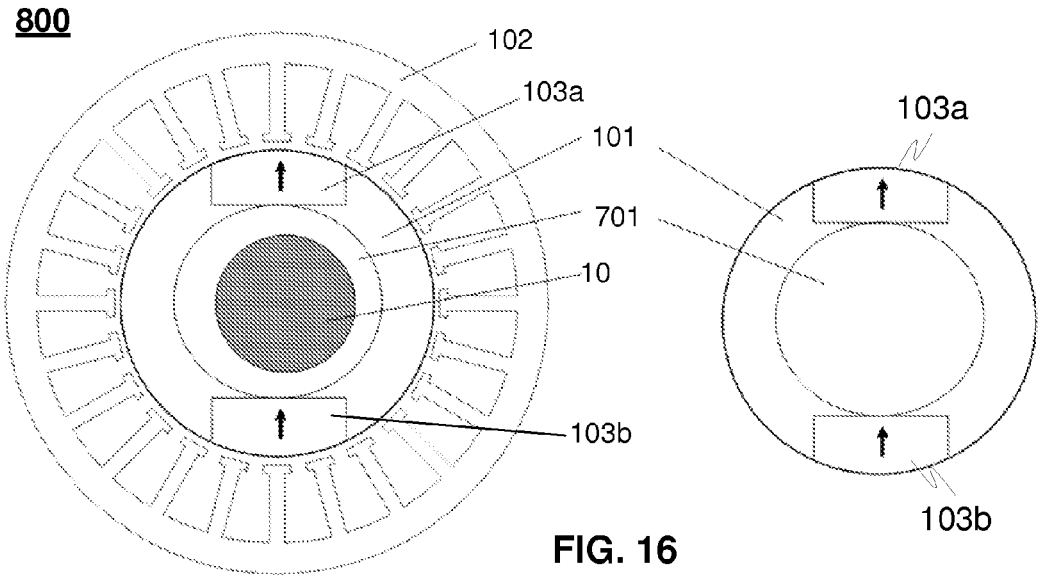
FIG. 16 illustrates an exemplary device with a centric hole for heating an object via electromagnetic induction according to an advantageous embodiment of the invention.

FIG. 16 illustrates an exemplary device 800 with a centric hole 701 (typically filled by air) for heating an object 10 via electromagnetic induction according to an advantageous embodiment of the invention. The object 10 can be introduced within the hole 701 so that the rotor 101 with permanent magnets 101*a*, 101*b* rotates around the object 10. The stator 102 used for rotating said rotor via varying magnetic field is arranged around the rotor 101 so that the varying magnetic field induced by the stator 102 influences with the permanent magnets 103*a*, 103*b* of the rotor and causes the rotor 101 to rotate. It should be noted that the axial axis of the object to be heated does not need to be common with the axial axis of the rotor or stator. In addition it is to be noted that according to an embodiment of the invention a conventional electric motor (such as e.g. 2-pole coiled) can be modified by replacing its rotor by the rotor 101 of the invention, where advantageously the core 701 of the rotor is hollow. In addition the permanent magnets 101*a*, 101*b* of the rotor 101 are advantageously adapted to be the same for rotating the rotor (interacting with the varying magnetic field provided by the stator 102) and inducing eddy currents within the object 10 to be heated.

Figure 17:
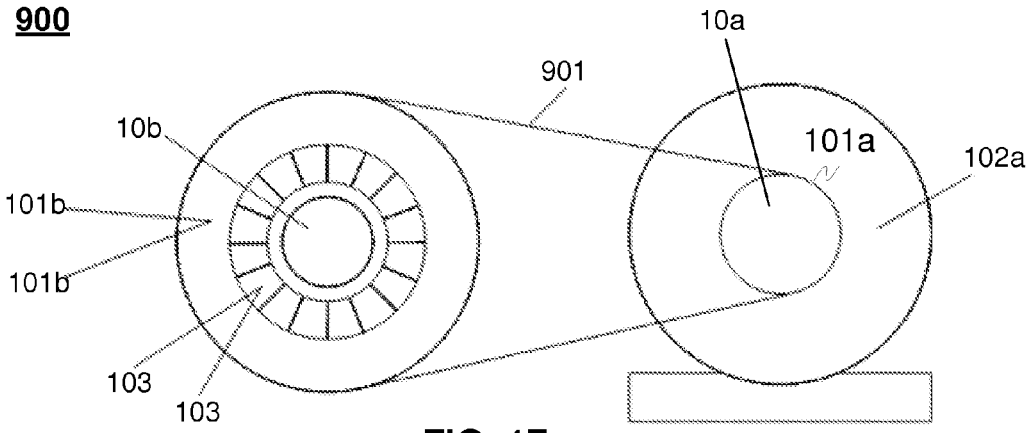
FIG. 17 illustrates an exemplary device with an additional rotor for heating an object via electromagnetic induction according to an advantageous embodiment of the invention.

FIG. 17 illustrates an exemplary device 900 with an additional rotor 101*b* for heating an object 10 via electromagnetic induction according to an advantageous embodiment of the invention. The device 900 comprises advantageously only one stator 102*a* for rotating the rotor 101*a*, which may be used for heating an object 10*a*, as discussed elsewhere in this document. The device 900 advantageously comprises additional rotor 101*b* with permanent magnets 103 for heating another object 10*b*, as discussed elsewhere in this document. Now the rotating force and thus the rotation of the second rotor 101*b* are arranged via a driving mechanism 901, such as a belt gear or the like. The driving mechanism advantageously delivers the rotating force from the first rotor 101*a*, which is rotated by the varying magnetic field induced by the stator 102. The rotor 101*b* may comprise centric hole where the object 10*b* to be heated may be introduced (as depicted in FIGS. 15 and 16), or the rotor may be like the rotors depicted elsewhere in this document (e.g. in FIG. 9).

Figure 18:
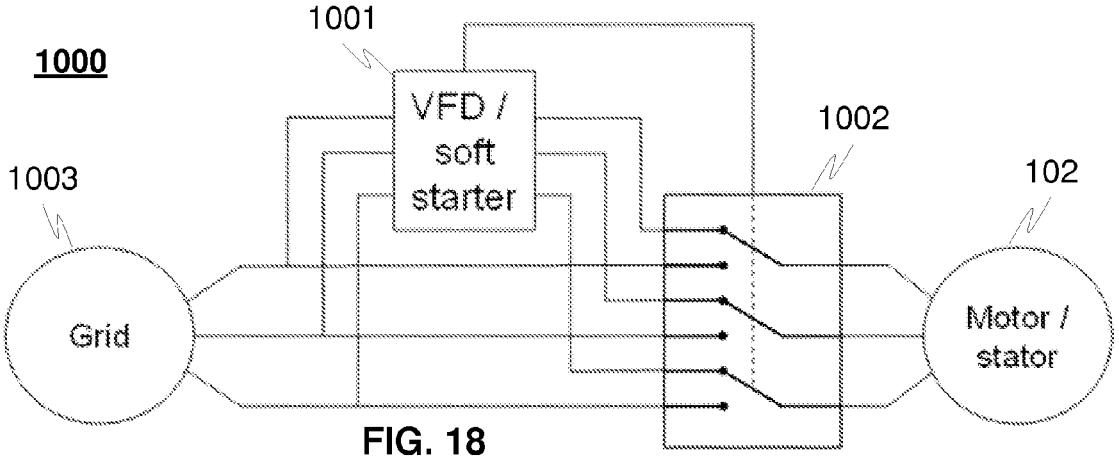
FIG. 18 illustrates an exemplary driver arrangement for supplying electric power for an induction heating means according to an advantageous embodiment of the invention.

FIG. 18 illustrates an exemplary driver arrangement 1000 for supplying electric power for an induction heating means, such as for a stator 102 according to an advantageous embodiment of the invention. The induction heating means comprises advantageously in addition to the stator 102 also at least one rotor the rotation force rotating said rotor is somehow caused by the stator, for example as described in this document elsewhere. The rotation of the rotor is advantageously induced by a varying magnetic field provided by said stator, wherein the rotor is arranged to rotate at least one magnet in order to inductively heat an object.

The driver arrangement 1000 comprises a variable frequency drive and/or direct on line starter (DOL, soft starter) 1001 for starting up and accelerating the rotation of the rotor via the varying magnetic field provided by said stator. The rotor (or in some embodiment plurality of rotors) with the magnets may weight tens or even hundreds of kilograms and having large moment of inertia, whereby it is more efficient to first accelerate the rotor with the magnets and afterwards (when the rotor rotates at the speed wanted) introduce the object to be heated into the magnetic fields of the rotor(s) inducing eddy currents within the object to be heated.

This has an advantage since the rotational energy can be stored in the angular momentum of the rotor(s) before introducing the object to be heated, which causes reversing force into the rotor(s). When the device is started and accelerated without the object only minimal power is needed to supply when if the object is already in the proximity of the magnets. In addition it should be noted that the nominal power needed by the variable frequency drive and/or direct on line starter (DOL, soft starter) 1001 is only a fraction (typically only 10-15%) of the maximum power of the induction heating device of the invention when operating.

The driver arrangement 1000 advantageously comprises also switching means 1002 for connecting the stator 102 electrically to the electrical network 1003 (and thus also to the grid frequency, grid 50-60 Hz) advantageously after accelerating the rotation of the rotor and advantageously before introducing said object to be heated under the varying magnetic field and induction heating provided by said at least one magnet rotated by said rotor. By using the suitable switching means 1002 the higher coefficient of efficiency of the device can be achieved, since the variable frequency drive consumed about 2% of the power.

When the object is introduced with the magnetic field generated by the rotating magnets, the torque and load and thus also power needed to supply is increased, whereupon the power is taken for example directly from the electrical network. By the embodiment using the driver arrangement 1000 the more powerful and efficient induction heating device can be achieved.

For example, if a 500 kW induction heating device is driven by a 500 kW motor/stator (instrumental cost noted as 0.5 times X) and 500 kW Variable Frequency Drive (VFD, cost about the same as the motor (0.5 times X)), the total instrumental cost of the motor+VFD would be about 0.5 X+0.5 X=X.

Another option according to the invention to start and drive the motor is to use a 500 kW Direct Online Starter (DOL, soft starter) which cost is about 40% of the VFD cost (0.4 times 0.5 X=0.2 times X), i.e. the total instrumental cost of the system would be about 0.5 X+0.2 X=0.7 X (i.e. the costs of this embodiment is 30% cheaper than costs of motor+full size VFD).

By using an embodiment of the invention shown in FIG. 18, one can have a DOL of only 50 kW (instrumental costs about 0.02 X) and additionally also a separate switching means (relay, contactor, etc) capable to handle 500 kW of power (costs about 0.05 X), which gives a total instrumental costs of for this embodiment of about 0.5 X+0.02 X+0.05 X=0.57 X (i.e. the instrumental costs of this embodiment is about 43% cheaper than the first one presented).

Thus it is clear that the driver arrangement 1000 according to the invention offers huge savings in electricity costs.

Figure 19:
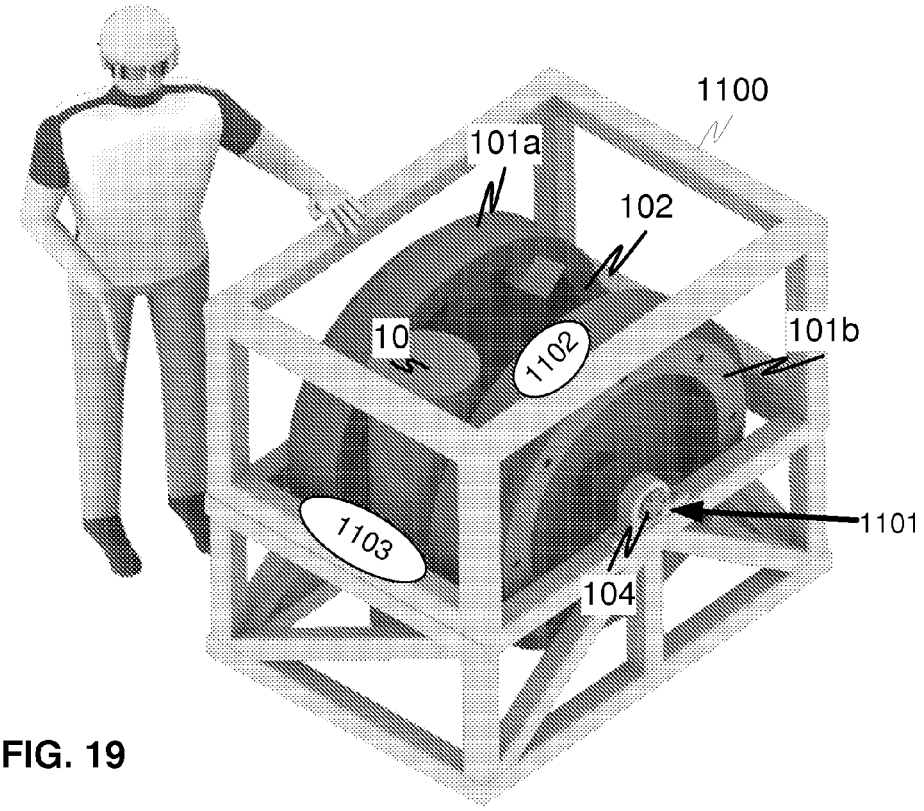
FIG. 19 illustrates an exemplary rack arrangement with an induction heating device for heating an object via electromagnetic induction according to an advantageous embodiment of the invention.
Figure 20:
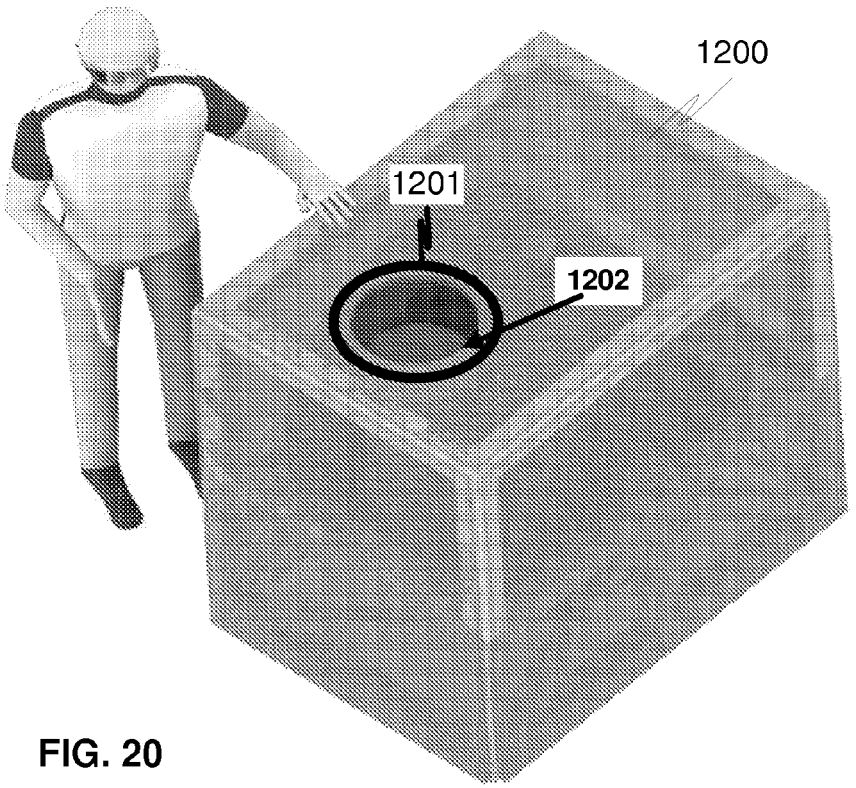
FIG. 20 illustrates an exemplary housing arrangement with an induction heating device for heating an object via electromagnetic induction according to an advantageous embodiment of the invention.

FIG. 19 illustrates an exemplary base arrangement 1100 with an induction heating device of the invention for heating an object 10 via electromagnetic induction according to an advantageous embodiment of the invention. The base 1100 is used for supporting the rotors 101*a*, 101*b* and stator(s) 102 of the induction heating devices illustrated elsewhere in this document. The supporting may be implemented e.g. via an axel 104. The base arrangement 1100 is very similar than the arrangement 900 illustrated in The arrangement 1100 as well as arrangement 900 illustrated in FIG. 9 can be provided by a housing arrangement 1200, as is illustrated in FIG. 20. The housing advantageously protects the users both physically as well as from the magnetic fields generated by the induction heating device. In addition it also provides protection for the induction heating device inside the housing e.g. by preventing unwanted objects to be introduced in the proximity of the induction heating device.

In addition according to an embodiment of the invention the device or the arrangement advantageously comprises magnetic filtering means 1201 arranged in the proximity of the induction heating device (such as near the portion or opening 1202 via which the object 10 to be heated is introduced into the induction magnetic field). The magnetic filtering means 1201 is advantageously adapted to magnetically catch essentially any loose particles in the proximity of the device or its opening 1202 in order to prevent the particles to be drifted in the contact of said stator, rotor and/or especially magnets of said rotor.

According to an embodiment of the invention the device may also comprise balance detecting means 1101 for detecting the balancing of the rotor when rotating and means for indicating the balance and/or unbalance. The balance detecting means may be arranged in the connection with the axis 104 around which the rotor is rotated.

According to an embodiment of the invention the device may also comprise magnetic flux detection means 1102 for detecting the magnetic flux of each magnets of the rotor when rotating. The magnetic flux detection means 1102 may be for example an induction loop. In addition the device may comprise means for indicating if the magnetic flux indication reveals any abnormal behaviour.

Moreover, according to an embodiment of the invention the device may also comprise distance detecting means 1103 for detecting the distance between the rotor 101*a*, 101*b* and the object 10 to be heated.

The invention has been explained above with reference to the aforementioned embodiments, and several advantages of the invention have been demonstrated. It is clear that the invention is not only restricted to these embodiments, but comprises all possible embodiments within the spirit and scope of the inventive thought and the following patent claims.

The invention claimed is:

1. A device for heating an object by an electromagnetic induction, wherein the device comprises:

at least one rotor arranged to heat the object, said at least one rotor comprising at least one permanent magnet, and a stator for providing varying magnetic field arranged to interact with at least one permanent magnet of said at least one rotor and causing said at least one rotor to rotate, wherein at least one permanent magnet of said at least one rotor is arranged to provide varying magnetic field and eddy currents within the object when said at least one rotor is rotated so that said object is heated by the electromagnetic induction generated by said varying magnetic field and eddy currents, and wherein the device comprises at least one additional rotor with at least one magnet, wherein at least one magnet of said additional rotor is used for heating at least one object by the electromagnetic induction, and wherein the device either comprises:

a) driving means for providing rotating force for rotating said additional rotor, the rotating force being derived from the rotor rotated by the varying magnetic field induced by the stator, or b) an additional stator used for rotating said additional rotor.

2. A device of claim 1, wherein at least one magnet of the rotor is same for a) providing varying magnetic field and eddy currents within the object, and b) interacting with the varying magnetic field provided by the stator.

3. A device of claim 1, wherein the stator is arranged to cover electromagnetically and/or physically a segment of the rotors surface, where the segment of the rotors surface is less than the full surface area of the rotor's surface facing towards the stator.

4. A device of claim 1, wherein the stator and the object to be heated are arranged in the same side of the rotor.

5. A device of claim 1, wherein at least one additional rotor is arranged to rotate in a different direction than at least one other rotor of the device.

6. A device of claim 1, wherein a soft magnetic material means is used for magnetically short circuiting the magnet circuit of the magnets of the rotor in the side opposite of the side facing essentially towards the stator in the case where stator and the object to be heated are arranged in the same side of the rotor.

7. A device of claim 1, wherein the rotor is a conical-shaped rotor.

8. A device of claim 1, wherein the rotor with the magnets is arranged essentially between the object to be heated and the stator.

9. A device of claim 1, wherein the rotor is arranged to rotate around the common axis of the stator and rotor and wherein the axis of the stator and rotor comprise a hole adapted for receiving the object to be heated.

10. A device of claim 1, wherein the device comprises means for detecting the balancing of the rotor when rotating and means for indicating the balance and/or unbalance.

11. A device of claim 1, wherein the device comprises means for detecting the magnetic flux of each magnets of the rotor when rotating, such as an induction loop, and means for indicating if the detection reveals any abnormal behaviour.

12. A device of claim 1, wherein the device comprises means for detecting the distance between the rotor and the object to be heated.

13. A device of claim 1, wherein the rotor comprises cooling element advantageously arranged to cool the rotor when rotated, such as a wing or cooling channel.

14. A rotor for heating an object by an electromagnetic induction, the rotor comprising at least one permanent magnet arranged to provide varying magnetic field and eddy currents within the object to be heated when said rotor is rotated in a proximity of the object, so that said object is heated by the electromagnetic induction generated by said varying magnetic field and eddy currents, wherein at least one permanent magnet of the rotor is arranged to interact with a varying magnetic field provided by a stator so that to cause said rotor to rotate, and wherein at least one magnet of said rotor is arranged to provide varying magnetic field and eddy currents within the object when said rotor is rotated by the varying magnetic field provided by said stator so that said object is heated by the electromagnetic induction generated by said varying magnetic field and eddy currents, and wherein the rotor is rotated by a motor either directly or via driving means transferring the rotating force from the motor.

15. A device for heating an object by an electromagnetic induction, wherein the device comprises a rotor of claim 14.

16. An arrangement for heating an object by an electromagnetic induction, the arrangement comprising:

a device for heating an object by an electromagnetic induction, and supporting means for supporting said object to be heated in a proximity of the device, wherein the device comprises:

at least one rotor arranged to heat the object, said at least one rotor comprising at least one permanent magnet, and a stator for providing varying magnetic field arranged to interact with at least one permanent magnet of said at least one rotor and causing said at least one rotor to rotate, wherein at least one permanent magnet of said at least one rotor is arranged to provide varying magnetic field and eddy currents within the object when said at least one rotor is rotated so that said object is heated by the electromagnetic induction generated by said varying magnetic field and eddy currents, and wherein the supporting means is arranged to rotate the object to be heated around the axis of the object and/or moving the object to be heated essentially in the direction of the axis of the object.

17. Arrangement of claim 16, wherein the arrangement comprises magnetic filtering means arranged in the proximity of the device, where the magnetic filtering means is adapted to magnetically catch essentially any loose particles in the proximity of the device in order to prevent the particles to be drifted in the contact of said rotor and/or magnets of said rotor.

18. An arrangement of claim 16, wherein the arrangement comprises a driver arrangement for supplying electric power for a stator of an induction heating means, said induction heating means comprising said stator and a rotor, wherein the rotation of the rotor is induced by a varying magnetic field provided by said stator, and wherein the rotor is arranged to rotate at least one magnet in order to inductively heat an object, wherein the driver arrangement comprises a variable frequency drive and/or direct on line starter for starting up and accelerating the rotation of the rotor via the varying magnetic field provided by said stator, and switching means for connecting the stator electrically to the electrical network after accelerating the rotation of the rotor and advantageously before introducing said object to be heated under the varying magnetic field and induction heating provided by said at least one magnet rotated by said rotor.

* * * * *